US006038413A

United States Patent [19]

Otani et al.

[11] Patent Number: 6,038,413

[45] Date of Patent: Mar. 14, 2000

[54] DOCUMENT ORIGINAL SIMULATOR FOR IMAGE FOGGING DETECTION, AND IMAGE FOGGING TROUBLESHOOTING METHOD AND IMAGE FORMING APPARATUS USING THE SAME

[75] Inventors: Shintaro Otani; Toshimitsu Takakura, both of Osaka, Japan

[73] Assignee: Mita Industrial Co., Ltd., Osaka, Japan

[21] Appl. No.: 09/287,132

[22] Filed: Apr. 7, 1999

[30] Foreign Application Priority Data

Apr. 28, 1998 [JP] Japan ..... 10-119736

[51] Int. Cl.[7] ..... G03G 15/00

[52] U.S. Cl. ..... 399/74; 399/72

[58] Field of Search ..... 399/45, 46, 47, 399/49, 50, 51, 52, 55, 58, 59, 60, 72, 73, 74, 11

[56] References Cited

U.S. PATENT DOCUMENTS 5,198,861 3/1993 Hasegawa et al. ..... 399/74
5,477,312 12/1995 Hori ..... 399/74
5,652,952 7/1997 Katsuhara ..... 399/74

*Primary Examiner*—Matthew S. Smith
*Assistant Examiner*—Hoang Ngo
*Attorney, Agent, or Firm*—Smith, Gambrell & Russell, LLP; Beveridge, DeGrandi, Weilacher & Young

[57] ABSTRACT

A document original simulator including first tone simulation portion having substantially the same reflectance as a white original sheet and a second tone simulation portion having a lower reflectance than the first tone simulation portion. When an image fogging detecting operation is to be performed with the use of the document original simulator, it is checked whether or not the amount of light reflected from the first tone simulation portion when the first tone simulation portion is illuminated with light is smaller than the amount of light reflected from the white original sheet placed on a document original presenting section when the white original sheet is illuminated with light. If the amount of the light reflected from the first tone simulation portion of the document original simulator is smaller than the amount of the light reflected from the white original sheet, the image fogging detecting operation is performed with the use of the first tone simulation portion of the document original simulator. If not, the image fogging detecting operation is performed with the use of the second tone simulation portion of the document original simulator.

7 Claims, 4 Drawing Sheets

DOCUMENT ORIGINAL SIMULATOR FOR IMAGE FOGGING DETECTION, AND IMAGE FOGGING TROUBLESHOOTING METHOD AND IMAGE FORMING APPARATUS USING THE SAME

BACKGROUND OF THE INVENTION

1. Field of the Invention

The present invention relates to a document original simulator for image fogging detection for use in an image forming apparatus such as a copying machine, and an image fogging troubleshooting method and an image forming apparatus using such a document original simulator.

2. Description of Related Art

Copying machines are generally adapted to form an electrostatic latent image on a photoreceptor drum by exposing an original image to light, then develop the electrostatic latent image by means of a developing device for formation of a visible toner image on the photoreceptor drum, and transfer the toner image onto a recording sheet by means of a transfer device.

The assignee of the present invention has been making efforts to develop a self-recovery system which is adapted to detect, by means of a density detector, an imaging failure which may be caused by changes in conditions of a copying machine due to malfunction or aging of the copying machine, and to restore the copying machine to a normal state to allow for normal image formation.

More specifically, such a self-recovery system employs, for example, a document original simulator which has black, white and gray simulation portions. Densities of toner image portions corresponding to these simulation portions are preliminarily determined in a normal state by the density detector, and stored. In maintenance of the copying machine or after repair of the copying machine, densities of toner image portions corresponding to the black, white and gray simulation portions of the document original simulator are determined by the density detector.

If the densities thus determined are different from the densities determined in the normal state, density-related parameters such as the amount of light exposure, the charge potential of the photoreceptor and a developing bias are adjusted so that the densities of the toner image portions corresponding to the black, white and gray simulation portions of the document original simulator are equated with the corresponding normal toner image densities.

SUMMARY OF THE INVENTION

It is an object of the present invention to provide a document original simulator which allows for highly accurate and reliable detection of image fogging, and to provide an image fogging troubleshooting method and an image forming apparatus using such a document original simulator.

The document original simulator according to the present invention comprises a first tone simulation portion having substantially the same reflectance as a white original sheet and a second tone simulation portion having a lower reflectance than the first tone simulation portion.

The image fogging troubleshooting method according to the present invention comprises the steps of: using a document original simulator which has a first tone simulation portion having substantially the same reflectance as a white original sheet and a second tone simulation portion having a lower reflectance than the first tone simulation portion; checking, for the image fogging detection with the document original simulator, whether or not the amount of light reflected from the first tone simulation portion of the document original simulator is smaller than the amount of light reflected from a white original sheet placed on a contact glass; detecting the image fogging with the use of the first tone simulation portion of the document original simulator if the amount of the light reflected from the first tone simulation portion is smaller than the amount of the light reflected from the white original sheet; and detecting the image fogging with the use of the second tone simulation portion of the document original simulator if the amount of the light reflected from the first tone simulation portion is not smaller than the amount of the light reflected from the white original sheet.

The first tone simulation portion of the document original simulator preferably has a density of not lower than 0.18 and not higher than 0.24, and the second tone simulation portion of the document original simulator preferably has a density of not lower than 0.24 and not higher than 0.30. However, the density of the first tone simulation portion of the document original simulator is set lower than the density of the second tone simulation portion.

The foregoing and other objects, features and effects of the present invention will become more apparent from the following description of the preferred embodiments with reference to the attached drawings.

DESCRIPTION OF THE PREFERRED EMBODIMENTS

Figure 1:
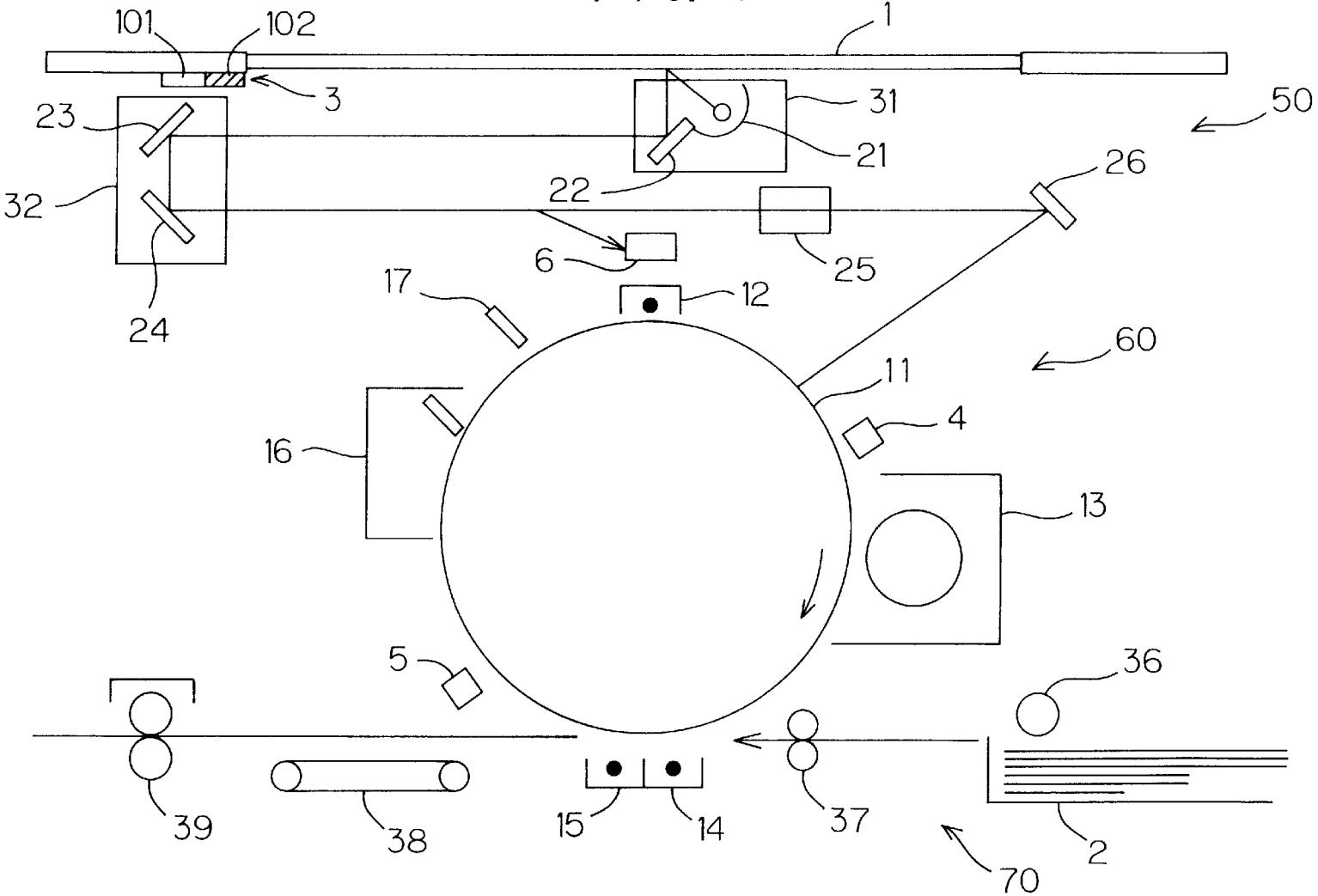
FIG. 1 is a diagram schematically illustrating the construction of a copying machine.

FIG. 1 illustrates the construction of a copying machine.

A contact glass 1 (document original presenting section) on which a document original to be copied is placed is provided atop a main body of the copying machine. A sheet cassette 2 is provided on one lateral side of the copying machine body. A light exposure mechanism 50, a print mechanism 60 and a recording sheet transport mechanism 70 are provided within the copying machine body. A document original simulator 3 having two tone simulation portions 101, 102 is provided on one side of the contact glass 1 in a position where the document original simulator can be exposed to light by the light exposure mechanism 50.

The print mechanism 60 includes a photoreceptor drum 11. The photoreceptor drum 11 is driven by a main motor not shown so as to be rotated in the direction indicated by an arrow. A charger 12 for charging a photosensitive surface layer of the photoreceptor drum 11, a developer 13 for developing an electrostatic latent image formed on the photosensitive layer into a visible toner image, a transfer charger 14 for transferring the toner image formed on the photosensitive layer onto a recording sheet, a separation charger 15 for separating the recording sheet from the photoreceptor drum 11, a cleaning device 16 for removing residual toner on the photoreceptor drum 11 after the transfer, and a charge remover 17 for removing charges from the surface of the photoreceptor drum 11 are provided around the photoreceptor drum 11 in the order named in the direction of the rotation of the photoreceptor drum 11.

Further, a surface potential sensor 4 for measuring the charge potential of the photoreceptor drum 11 and a reflective photosensor 5 (image density detection mechanism) for measuring densities of toner image portions corresponding to the tone simulation portions 101, 102 of the document original simulator 3 are provided around the photoreceptor drum 11. The reflective photosensor 5 includes a light emitting diode (light emitting member) for illuminating the surface of the photoreceptor drum 11 and a phototransistor (light receiving member) for receiving light reflected from the photoreceptor drum surface.

The light exposure mechanism 50 includes a light exposure lamp 21 for illuminating and scanning with light an image of a document original (not shown) placed on the contact glass 1, a first movable optical system 31 including a first mirror 22 for reflecting the light reflected from the document original, a second movable optical system 32 including second and third mirrors 23, 24 for guiding the light reflected by the first mirror 22 to a lens 25, and a fourth mirror 26 for guiding the light projected from the lens 25 onto the surface of the photoreceptor drum 11. The print mechanism 60 is operative in association with the light exposure mechanism 50 to form a visible toner image corresponding to the light reflected from the document original on the surface of the photoreceptor drum 11.

Further, a light amount sensor 6 (light amount detection mechanism) for measuring the amount of the light reflected from the document original simulator 3 is provided in the copying machine body.

The first movable optical system 31 and the second movable optical system 32 are laterally reciprocally moved by a scan motor not shown. The second movable optical system 32 is moved at a speed one half the speed of the first movable optical system 31 by a distance one half the traveling distance of the first movable optical system 31.

The recording sheet transport mechanism 70 includes a sheet feeding roller 36 for feeding a recording sheet from the sheet cassette 2, a registration roller pair 37 for feeding the recording sheet fed by the sheet feeding roller 36 to the photoreceptor drum 11 in a predetermined timing, and a transport belt 38. The transport belt 38 transports to a fixation roller pair 39 the recording sheet carrying the toner image transferred thereon from the photoreceptor drum 11 and separated from the photoreceptor drum 11.

Figure 2:
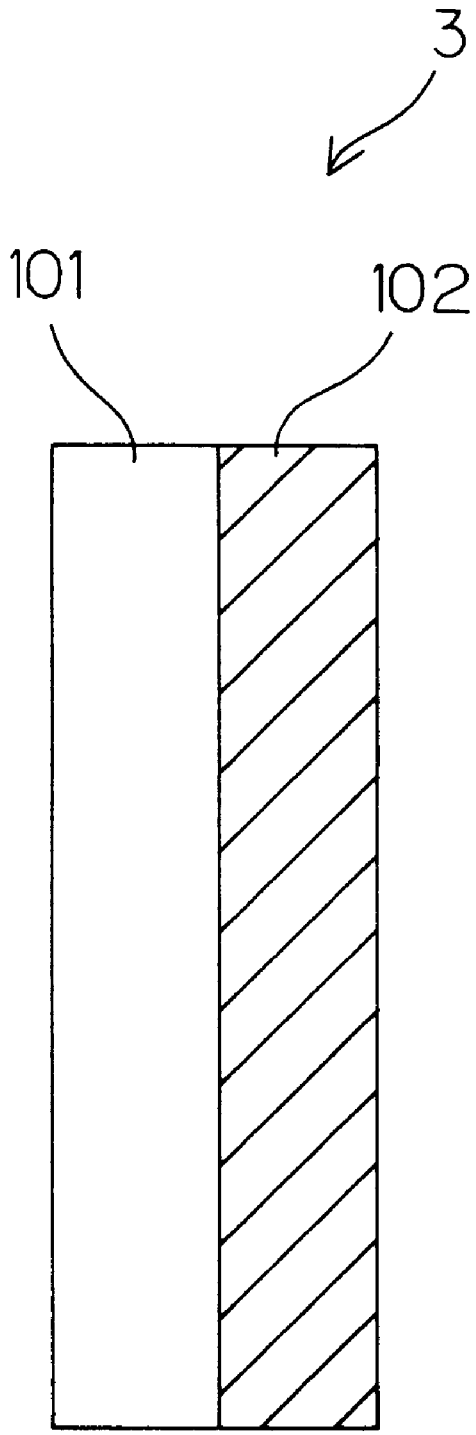
FIG. 2 is a bottom view of a document original simulator.

As shown in FIGS. 1 and 2, the document original simulator 3 includes the first tone simulation portion 101 which has substantially the same reflectance as a white original sheet and the second tone simulation portion 102 which has a lower reflectance than the first tone simulation portion 101 for detection of image fogging. The first tone simulation portion 101 has a tone close to white, while the second tone simulation portion 102 has a grayish tone having a brightness slightly lower than the tone of the first tone simulation portion 101.

A document original simulator for the image fogging detection is used for density reproduction to check whether or not the image fogging occurs. If a document original simulator having exactly the same reflectance as the white original sheet placed on the contact glass 1 is used for the image fogging detection, whether or not the image fogging occurs can ideally be checked by performing a copying operation with the use of this document original simulator.

More specifically, a document original simulator to be used for the image fogging detection preferably has a reflectance as close as possible to the white original sheet placed on the contact glass 1. Therefore, the reflectance of the first tone simulation portion 101 of the document original simulator is set at a level which is virtually equal to the reflectance of the white original placed on the contact glass 1.

Where the first tone simulation portion 101 of the document original simulator is used alone for the image fogging detection, however, the reflection light amount obtained when the first tone simulation portion 101 is illuminated with light varies due to variations in the tone of the first tone simulation portion 101, the mounting position of the document original simulator 3 in the copying machine, and the mechanical properties of the copying machine.

If the amount of the light reflected from the first tone simulation portion 101 exceeds the amount of the light reflected from a white original sheet placed on the contact glass 1 due to the variations, the accuracy of the image fogging detection is significantly reduced. In such a case, the image fogging cannot be detected when the copying operation is performed with respect to the first tone simulation portion 101 of the document original simulator, even though the image fogging actually occurs when the copying operation is performed with respect to the white original sheet placed on the contact glass 1.

The second tone simulation portion 102 has a tone having a reflectance slightly lower than the reflectance of the first tone simulation portion 101. In consideration of the variations in the tone of the first tone simulation portion 101, the mounting position of the document original simulator 3 in the copying machine and the mechanical properties of the copying machine, the reflectance of the second tone simulation portion 102 is set slightly lower than the reflectance of the first tone simulation portion 101 so that the amount of the light reflected from the second tone simulation portion 102 does not exceed the amount of the light reflected from a white original sheet placed on the contact glass 1.

The density of the first tone simulation portion 101 of the document original simulator is preferably set at a level of not lower than 0.18 and not higher than 0.24, for example, at 0.217. Further, the density of the second tone simulation portion 102 is preferably set at a level of not lower than 0.24 and not higher than 0.30, for example, at 0.273. The density is calculated on the basis of log 1/R wherein log represents common logarithm, and R represents a reflectance (=reflected light/projected light) as measured by means of TC-6DS available from Tokyo Denshoku Co.

Figure 3:
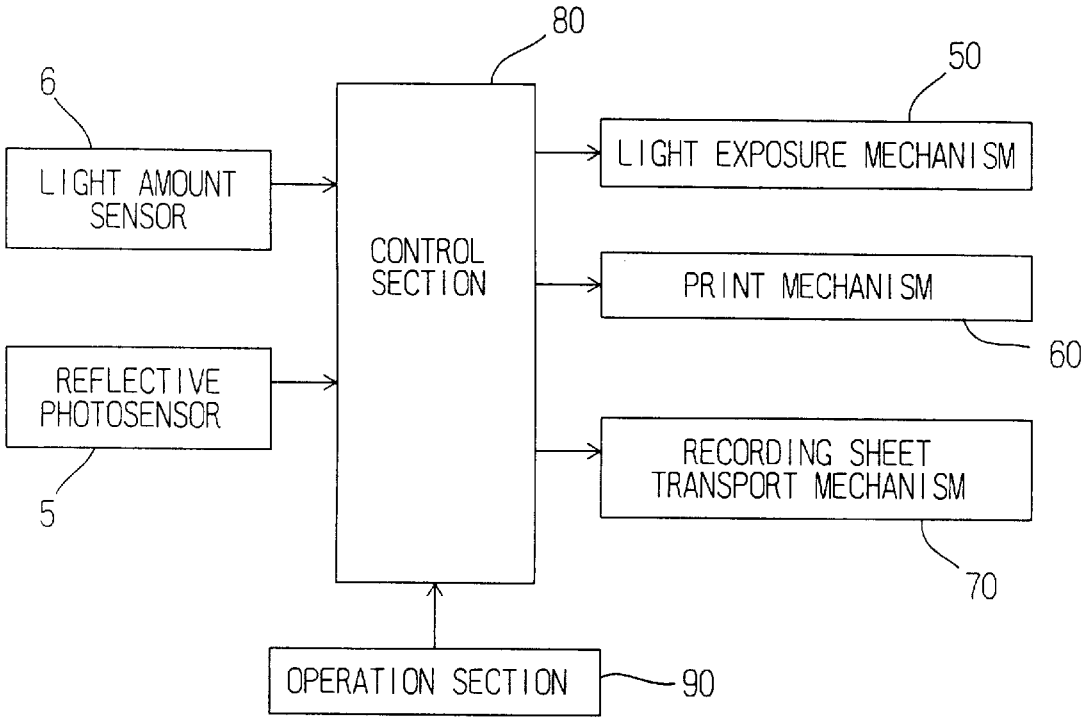
FIG. 3 is a block diagram illustrating the electrical construction of the copying machine.

FIG. 3 is a block diagram illustrating the electrical construction of major portions of the copying machine. Operations of the light exposure mechanism 50, the print mechanism 60 and the recording sheet transport mechanism 70 are controlled by a control section 80 (image fogging troubleshooting means) having a microprocessor. Output signals from the reflective photosensor 5 and the light amount sensor 6 and output signals from an operation section 90 comprised of a key input section and the like are applied to the control section 80.

Figure 4:
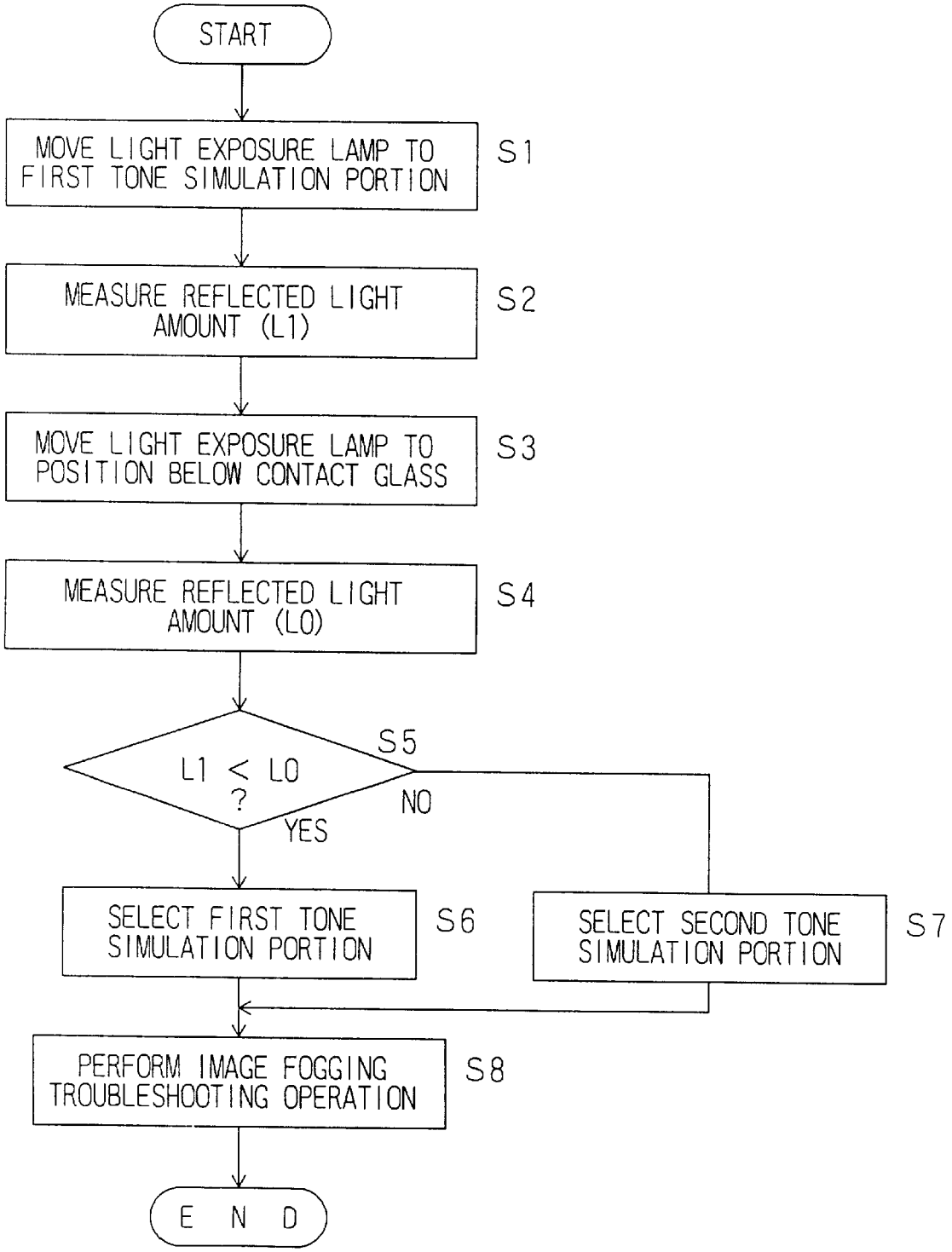
FIG. 4 is a flow chart for explaining a process to be performed for detection of image fogging.

In maintenance of the copying machine or after repair of the copying machine, a serviceman places a white original sheet on the contact glass 1, and operates the operation section 90 to input a command for an image fogging detecting operation. In response thereto, the control section 80 performs the operation as shown in the flow chart of FIG. 4.

More specifically, the control section 80 controls the light exposure mechanism 50 to move the light exposure lamp 21 to a position adjacent to the first tone simulation portion 101 of the document original simulator 3 (Step S1). Then, the light amount sensor 6 measures the amount L1 of the light reflected from the first tone simulation portion 101 illuminated by the light exposure lamp 21 (Step S2).

In turn, the control section 80 controls the light exposure mechanism 50 to move the light exposure lamp 21 to a position below the white original sheet placed on the contact glass 1 (Step S3). Then, the light amount sensor 6 measures the amount L0 of the light reflected from the white original sheet illuminated by the light exposure lamp 21 (Step S4).

The control section 80 compares the light amount L1 with the light amount L0 (Step S5).

If the amount L1 of the light reflected from the first tone simulation portion 101 of the document original simulator is smaller than the amount L0 of the light reflected from the white original sheet placed on the contact glass 1, the control section 80 selects the first tone simulation portion 101 of the document original simulator 3 (Step S6), and checks for the image fogging with the use of the first tone simulation portion 101 (Step S8). If the amount L1 of the light reflected from the first tone simulation portion 101 is not smaller than the amount L0 of the light reflected from the white original sheet placed on the contact glass 1, the control section 80 selects the second tone simulation portion 102 of the document original simulator 3 (Step S7), and checks for the image fogging with the use of the second tone simulation portion (Step S8).

In the troubleshooting of the image fogging, the control section 80 illuminates the selected tone simulation portion of the document original simulator with the light exposure lamp 21 and, in this state, performs the copying operation by means of the print mechanism 60. Thus, a visible toner image is formed on the surface of the photoreceptor 11, and the density of the toner image is sensed by the reflective photosensor 5. The density thus sensed is compared with a predetermined reference density level for checking whether or not the image fogging occurs. The comparison of the sensed density with the reference density level may be performed by the serviceman or by the control section 80.

A self-recovery system for automatically remedying the image fogging, for example, can be constructed which is adapted to perform the aforesaid comparison by means of the control section 80 and to automatically change parameters (the amount of light exposure, the charge potential of the photoreceptor, the developing bias, etc.) on the basis of the result of the comparison.

In this embodiment, the image fogging is checked by employing the first tone simulation portion 101 which provides a reflection light amount close to the amount of the light reflected from the white original sheet placed on the contact glass. Where the amount of the light reflected from the first tone simulation portion 101 of the document original simulator exceeds the amount of the light reflected from the white original sheet due to variations in the tone of the first tone simulation portion 101 of the document original simulator, the mounting position of the document original simulator 3 in the copying machine and the mechanical properties of the copying machine, the second tone simulation portion 102 of the document original simulator having a lower reflectance than the first tone simulation portion 101 is used to check for the image fogging.

Therefore, this embodiment allows for highly accurate and reliable detection of the image fogging.

In this embodiment, the document original simulator comprises the first tone simulation portion 101 and the second tone simulation portion 102, but may further comprise a black simulation portion for reproducing a saturation density in the copying machine and/or a gray simulation portion for reproducing an intermediate density.

While the present invention has been described in detail by way of the embodiment thereof, it should be understood that the foregoing disclosure is merely illustrative of the technical principles of the present invention but not limitative of the same. The spirit and scope of the present invention are to be limited only by the appended claims.

This application claims priority benefits under 35 USC Section 119 on the basis of Japanese Patent Application No. 10-119736 filed to the Japanese Patent Office on Apr. 28, 1998, the disclosure thereof being incorporated herein by no reference.

What is claimed is:

1. A document original simulator, comprising:

a first tone simulation portion for image fogging detection, the first tone simulation portion having a density of not lower than 0.18 and not higher than 0.24, and having substantially the same reflectance as a white original sheet; and a second tone simulation portion for image fogging detection, the second tone simulation portion having a density of not lower than 0.24 and not higher than 0.30, and having a lower reflectance than the first tone simulation portion, and wherein the density of the first tone simulation portion is set lower than the density of the second tone simulation portion.

2. An image fogging troubleshooting method, comprising the steps of:

using a document original simulator which has a first tone simulation portion having substantially the same reflectance as a white original sheet and a second tone simulation portion having a lower reflectance than the first tone simulation portion;

checking, for the image fogging detection with the use of the document original simulator, whether or not an amount of light reflected from the first tone simulation portion of the document original simulator when the first tone simulation portion is illuminated with light is smaller than an amount of light reflected from a white original sheet placed on a document original presenting section when the white original sheet is illuminated with light;

detecting the image fogging with the use of the first tone simulation portion of the document original simulator if the amount of the light reflected from the first tone simulation portion is smaller than the amount of the light reflected from the white original sheet; and detecting the image fogging with the use of the second tone simulation portion of the document original simulator if the amount of the light reflected from the first tone simulation portion is not smaller than the amount of the light reflected from the white original sheet.

3. An image fogging troubleshooting method as set forth in claim 2, wherein the first tone simulation portion has a density of not lower than 0.18 and not higher than 0.24 and the second tone simulation portion has a density of not lower than 0.24 and not higher than 0.30, wherein the density of the first tone simulation portion is set lower than the density of the second tone simulation portion.

4. An image forming apparatus, comprising:

a document original presenting section;

a document original simulator which has a first tone simulation portion with a density of not lower than 0.18 and not higher than 0.24 and with substantially the same reflectance as a white original sheet, and a second tone simulation portion with a density of not lower than 0.24 and not higher than 0.30 and with a lower reflectance than the first tone simulation portion, wherein the density of the first tone simulation portion is set lower than the density of the second tone simulation portion;

a light exposure mechanism capable of illuminating a document original placed on the document original presenting section and the document original simulator;

a light amount detection mechanism for measuring an amount of light reflected from the illuminated document original or document original simulator;

a print mechanism for forming an image on the basis of the light reflected from the document original or document original simulator exposed to light by means of the light exposure mechanism; and an image density detection mechanism for measuring a density of the image formed by means of the print mechanism.

5. An image forming apparatus as set forth in claim 4, further comprising image fogging detecting means for performing an image fogging detecting operation with the use of the document original simulator and the image density detection mechanism, wherein the image fogging troubleshooting means includes:

means for checking whether or not an amount of light reflected from the first tone simulation portion of the document original simulator when the first tone simulation portion is illuminated by the light exposure mechanism is smaller than an amount of light reflected from a white original sheet placed on the document original presenting section when the white original sheet is illuminated by the light exposure mechanism;

means for selecting the first tone simulation portion of the document original simulator and performing the image fogging detecting operation with the use of the first tone simulation portion if the amount of the light reflected from the first tone simulation portion is smaller than the amount of the light reflected from the white original sheet; and means for selecting the second tone simulation portion of the document original simulator and performing the image fogging detecting operation with the use of the second tone simulation portion if the amount of the light reflected from the first tone simulation portion is not smaller than the amount of the light reflected from the white original sheet.

6. An image forming apparatus as set forth in claim 4, wherein the image fogging troubleshooting means performs an image forming operation by means of the print mechanism with the selected one of the first and second tone simulation portions of the document original simulator being illuminated by the light exposure mechanism, and determines a density of an image formed through the image forming operation by means of the image density detection mechanism.

7. An image forming apparatus, comprising:

a document original presenting section;

a document original simulator which has a first tone simulation portion having substantially the same reflectance as a white original sheet, and a second tone simulation portion having a lower reflectance than the first tone simulation portion;

a light exposure mechanism capable of illuminating a document original placed on the document original presenting section and the document original simulator;

a light amount detection mechanism for measuring an amount of light reflected from the illuminated document original or document original simulator;

a print mechanism for forming an image on the basis of light reflected from the document original or document original simulator exposed to light by means of the light exposure mechanism;

an image density detection mechanism for measuring a density of the image formed by means of the print mechanism; and image fogging detecting means for performing an image fogging detecting operation with the use of the document original simulator and the image density detection mechanism, the image fogging troubleshooting means including:

means for checking whether or not an amount of light reflected from the first tone simulation portion of the document original simulator when the first tone simulation portion is illuminated by the light exposure mechanism is smaller than an amount of light reflected from a white original sheet placed on the document original presenting section when the white original sheet is illuminated by the light exposure mechanism;

means for selecting the first tone simulation portion of the document original simulator and performing the image fogging detecting operation with the use of the first tone simulation portion if the amount of light reflected from the first tone simulation portion is smaller than the amount of light reflected from the white original sheet; and means for selecting the second tone simulation portion of the document original simulator and performing the image fogging detecting operation with the use of the second tone simulation portion if the amount of light reflected from the first tone simulation portion is not smaller than the amount of light reflected from the white original sheet.

* * * * *